US007717814B1

(12) United States Patent
Sanford

(10) Patent No.: US 7,717,814 B1
(45) Date of Patent: May 18, 2010

(54) EXPANDABLE ARROW BROADHEAD WITH SPRING BIASED SLIDING SHAFT AND POINTED TIP

(75) Inventor: Chris G. Sanford, Billings, MT (US)

(73) Assignee: Bear Archery, Inc., Evansville, IN (US)

( * ) Notice: Subject to any disclaimer, the term of this patent is extended or adjusted under 35 U.S.C. 154(b) by 371 days.

(21) Appl. No.: 11/809,651

(22) Filed: Jun. 1, 2007

Related U.S. Application Data

(63) Continuation-in-part of application No. 11/410,771, filed on Apr. 24, 2006, now Pat. No. 7,226,375.

(51) Int. Cl.
*F42B 6/08* (2006.01)

(52) U.S. Cl. ..... 473/583

(58) Field of Classification Search ..... 473/583
See application file for complete search history.

(56) References Cited

U.S. PATENT DOCUMENTS

| | | | | |
|---|---|---|---|---|
| 2,859,970 | A | 11/1958 | Doonan | |
| 2,993,697 | A * | 7/1961 | Urban | 473/583 |
| 4,099,720 | A | 7/1978 | Zeren | |
| 4,973,060 | A * | 11/1990 | Herzing | 473/583 |
| 4,976,443 | A * | 12/1990 | DeLucia | 473/583 |
| 4,998,738 | A * | 3/1991 | Puckett | 473/583 |
| 5,066,021 | A * | 11/1991 | DeLucia | 473/583 |
| 5,082,292 | A * | 1/1992 | Puckett et al. | 473/583 |
| 5,100,143 | A | 3/1992 | Puckett et al. | |
| 5,322,297 | A | 6/1994 | Smith | |
| 5,941,784 | A | 8/1999 | Mizek | |
| 6,165,086 | A * | 12/2000 | Liechty, II | 473/583 |
| 6,200,237 | B1 * | 3/2001 | Barrie | 473/583 |
| 6,258,000 | B1 | 7/2001 | Liechty, II | |
| 6,270,435 | B1 | 8/2001 | Sodaro | |
| 6,517,454 | B2 | 2/2003 | Barrie et al. | |
| 6,626,776 | B2 | 9/2003 | Barrie et al. | |
| 6,669,586 | B2 | 12/2003 | Barrie et al. | |
| 6,935,976 | B1 | 8/2005 | Grace et al. | |
| 7,226,375 | B1 * | 6/2007 | Sanford | 473/583 |

* cited by examiner

*Primary Examiner*—John Ricci
(74) *Attorney, Agent, or Firm*—Woodard, Emhardt, Moriarty, McNett & Henry LLP

(57) ABSTRACT

An expandable arrow broadhead used for releasable attachment to one end of a hollow arrow shaft. The broadhead includes a rotating, sliding shaft with a spirally wound, scalloped grooved, pointed tip and tip base having two or more of cutting blades mounted thereon. A portion of the sliding shaft is slidably received inside a hollow collar attached to a sliding shaft housing. In a retracted position, the blades are held in a refracted position using a coil spring mounted in a collar bore in the sliding shaft housing and a blade catch extending outwardly from an inner edge of the cutting blades. When the pointed tip engages a target upon impact, the sliding shaft moves rearward sliding inside the hollow collar. As the sliding shaft moves rearward, the blades are released from the blade catch and the beveled cam surface engages a portion of the collar and moves the blades outwardly into an extended position.

24 Claims, 3 Drawing Sheets

EXPANDABLE ARROW BROADHEAD WITH SPRING BIASED SLIDING SHAFT AND POINTED TIP

This application is a Continuation-In-Part patent application of an application filed on Apr. 24, 2006, Ser. No. 11/410,771, now U.S. Pat. No. 7,226,375 by the subject inventor and having a title of "EXPANDABLE ARROW BROADHEAD FOR ATTACHMENT TO ONE END OF AN ARROW SHAFT. The inventor claims the benefit of the earlier filed application.

BACKGROUND OF THE INVENTION (a) Field of the Invention

This invention relates broadly to an expandable arrow broadhead and more particularly, but not by way of limitation, to an arrow broadhead having a rotating, sliding shaft received through a hollow collar mounted on a sliding shaft housing. An end of the hollow collar is used for extending outwardly at least two cutting blades, and preferably three cutting blades, upon impact on a target. During arrow flight, the cutting blades are held in a retracted position using a coil spring for biasing the sliding shaft in the sliding shaft housing forward and toward the direction of the target.

(b) Discussion of Prior Art

Heretofore, there have been a number of arrow broadheads having blades that extend outwardly when contacting a surface of a target. U.S. Pat. No. 6,935,976 to Grace, Jr. et al., discloses a mechanical broadhead having blades, mounted in longitudinal channels in a ferrule, that slide outwardly on a camming surface formed in an inward edge of each blade. U.S. Pat. No. 6,270,435 to Sodaro illustrates an arrowhead having spring loaded blades that expand outwardly upon contact with a target. U.S. Pat. Nos. 6,910,979, 6,626,776 and 6,517,454 to Barrie et al. disclose blades having longitudinal grooves in the blades and a camming member for extending the blades outwardly upon target impact. U.S. Pat. Nos. 6,669,586 and 6,200,237 to Barrie disclose blades mounted on a sliding body mounted on a length of the broadhead. As the sliding body moves rearwardly upon target impact, the blades engage a camming surface and are moved outwardly in an extended position.

None of the above mentioned prior art broadhead patents particularly disclose or teach the structure and function of an arrow broadhead having a rotating, sliding shaft with a pointed, scalloped grooved tip and cutting blades attached. The sliding shaft with pointed tip is biased forward during arrow flight by a coil spring mounted inside the sliding shaft housing. The bias force is used to hold the cutting blades in a retracted position. Also, the sliding shaft is designed to move rearward upon target impact with the blades expanding outwardly upon engaging a threaded collar attached to a sliding shaft housing.

SUMMARY OF THE INVENTION

In view of the foregoing, it is a primary objective of the subject invention to provide an aerodynamic, arrow broadhead that maintains cutting blades in a retracted folded, compact profile position, typically having an in-flight diameter of 0.55 inches, and next to a sliding shaft housing for little or no deflection at target contact. The arrow broadhead flight is similar to an arrow with field tip flight. This feature eliminates the need to adjust sight pins, which is a common complaint of mechanical and fixed broadheads, especially with bows that shoot over 300 fps. The cutting blades are held in the retracted position using a coil spring. The coil spring is mounted inside a collar bore hole in a sliding shaft housing. This feature eliminates the need of using a stretchable band received around a portion of the cutting blades during allow flight.

Another primary objective of the invention is using the broadhead's forward inertia and using a rotating, sliding shaft moving rearward in a hollow collar mounted on a sliding shaft housing, to almost instantaneously upon target contact to move the cutting blades into a fully open and locked position. The forward inertia of the arrow broadhead, the rotation of the cutting blades and the rotation of a spirally wound, scalloped-grooved pointed tip provide for an ultimate penetration of the target. This feature results in larger entry and exit holes, better blood trails and higher game recovery.

Yet another object of the broadhead is a unique streamlined, spirally wound, scalloped grooved pointed tip, which rotates during flight and upon target. This feature during flight reduces planning and wind resistance with improved flight accuracy. Also, this feature during target contact provides a drill-like motion for penetration through skin, bone and muscle and then into an animal's vital organs.

Still another object of the invention is the subject broadhead gives a hunter a distinct advantage during an angled shot, which will enter the target without deflection. This feature means the arrow with broadhead will enter the target exactly where it's aimed, thus resulting in better shot placement, better penetration and more target damage. Most mechanical broadheads can deflect on an angled shot, thereby causing poor penetration and missed vital organs.

The subject arrow broadhead includes a sliding shaft with a spirally wound, scalloped-grooved, pointed tip disposed in a front portion of the shaft. The pointed tip is tapered rearward and outward forming a tip base. The tip base includes cutting blade grooves formed therein and parallel to a length of the sliding shaft. The cutting blade grooves are used for receiving a pivot end of two or more of cutting blades. The pivot end of the cutting blades is pinned to sides of the grooves. Each of the blades includes an outer cutting edge and an inner edge. The inner edge of the blades includes a beveled cam surface disposed next to a portion of the length of the sliding shaft. The cam surface includes an inverted "V" shaped locking notch therein. A portion of the sliding shaft is slidably received inside a hollow collar. The collar is attached to a sliding shaft housing. In a retracted position, the blades are disposed next to and parallel to the length of the sliding shaft. The blades are held in a retracted position using a coil spring mounted in a collar bore in the sliding shaft housing and a blade catch extending outwardly from an inner edge of the cutting blades. When the pointed tip engages a target upon impact, the sliding shaft moves rearward sliding inside the collar. As the sliding shaft moves rearward, the blades are released from the blade catch and the beveled cam surface engages a portion of the collar and moves the blades outwardly into an extended position. At this time, the locking notch is received around a portion of the collar for holding the cutting blades in an extended, fixed and locked position during the engagement of the target.

These and other objects of the present invention will become apparent to those familiar with the use of arrow broadheads for hunting when reviewing the following detailed description, showing novel construction, combination, and elements as described, and more particularly defined by the claims, it being understood that changes in the embodiments to the disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for it's practical application and in which.

DETAILED DESCRIPTION OF THE PREFERRED EMBODIMENTS

Figure 1:
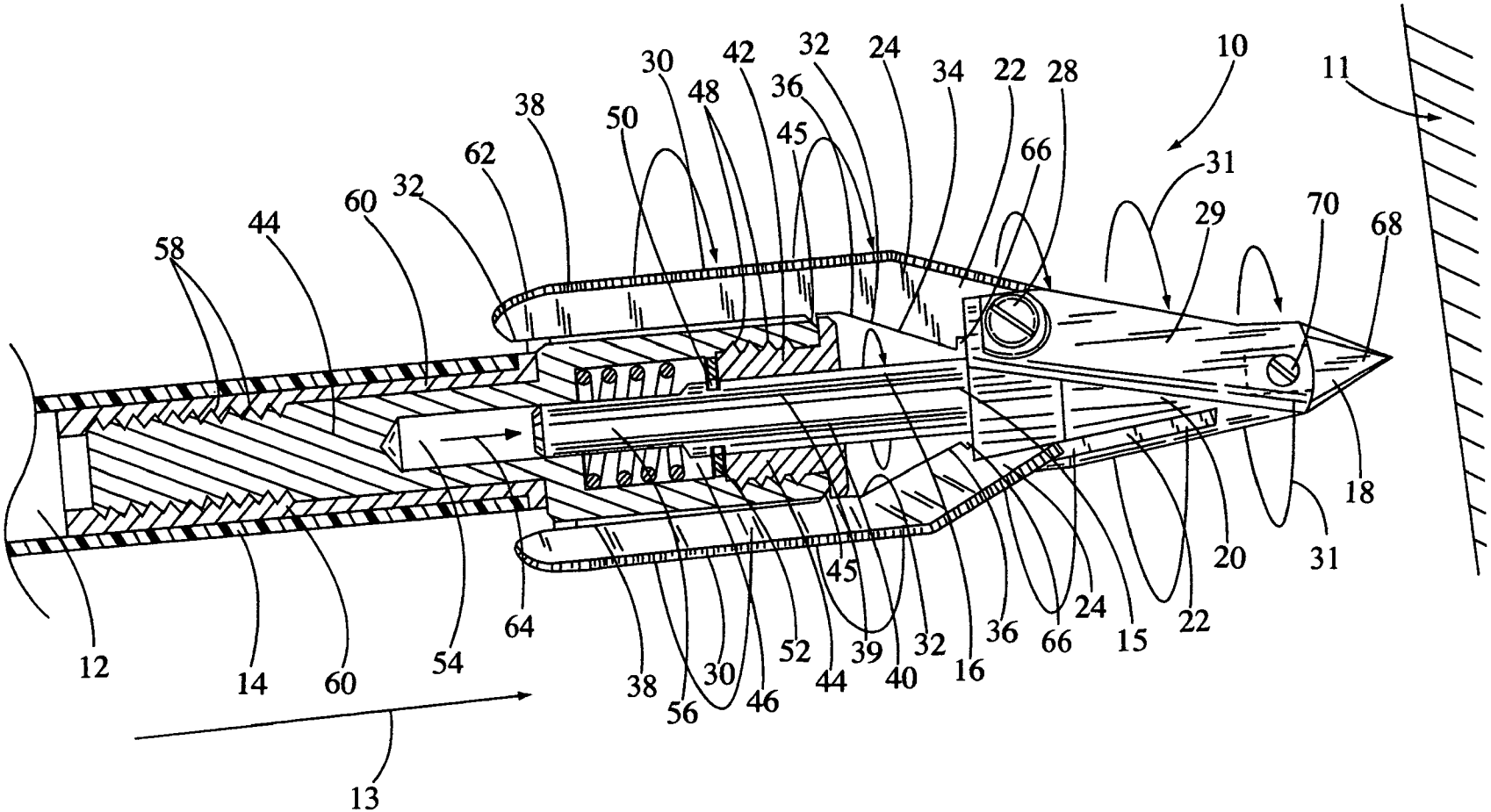
FIG. 1 is a perspective view of the subject arrow broadhead rotating in flight and prior to target contact. The cutting blades with blade catch are shown in a retracted position next to a side of a sliding shaft housing. The sliding shaft housing with attached threaded, hollow collar is shown in cross-section. The sliding shaft housing is used for receiving a portion of a rotating, sliding shaft attached to a pointed tip. A coil spring is shown received inside a collar bore in the sliding shaft housing for biasing the sliding shaft with pointed tip forward and biasing the blade catch against a lower lip of a crown on top of the hollow collar.

In FIG. 1, a perspective view of the subject aerodynamic arrow broadhead is shown in flight and having general reference numeral 10. In this drawing, the broadhead 10 is heading toward a target, having a general reference numeral 11. The flight of the broadhead 10 is indicated by arrow 13. The arrow broadhead 10 is adapted from mounting to an open end 12 of a hollow arrow shaft 14. A portion of the arrow shaft 14 is shown in cross section.

Figure 2:
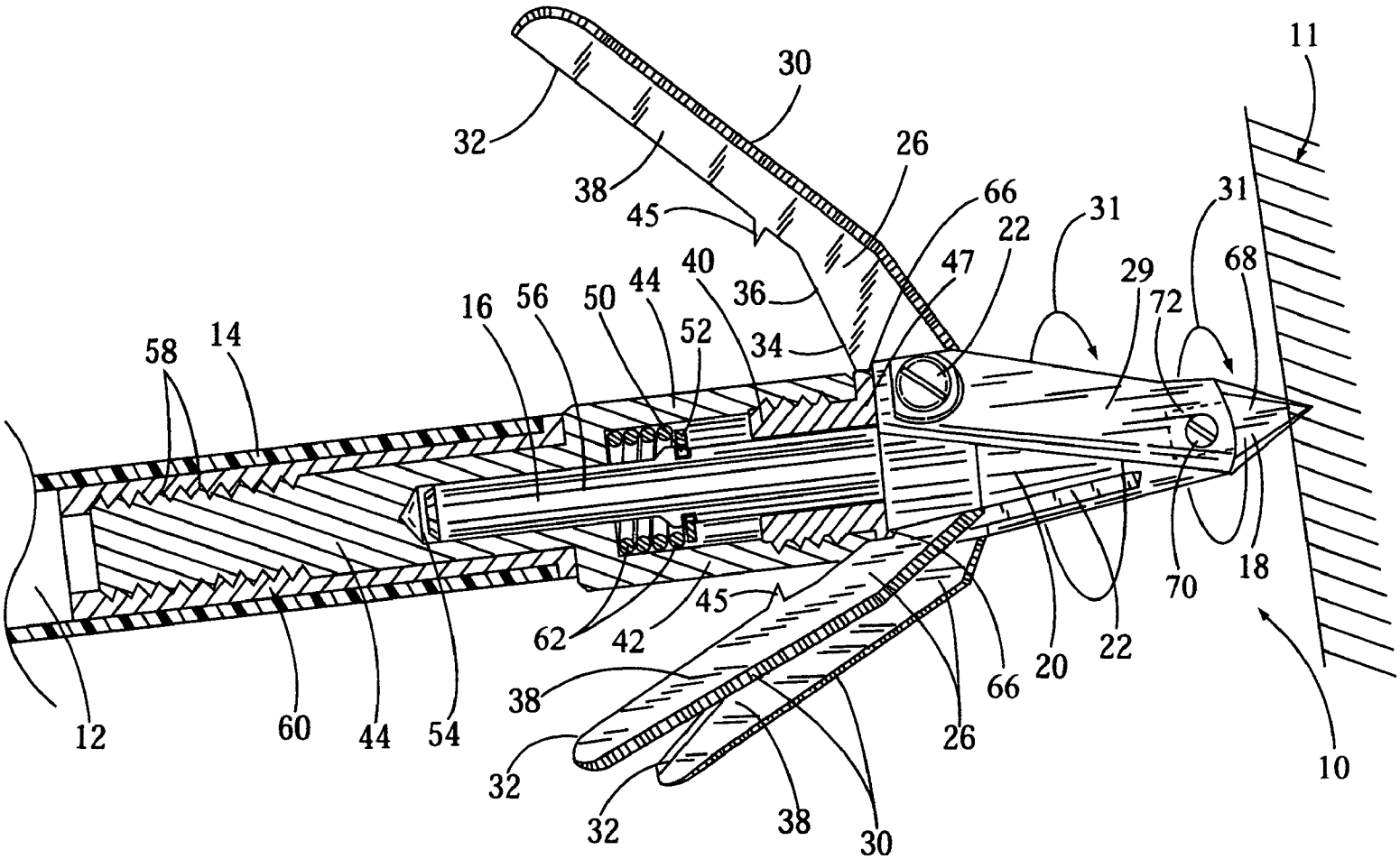
FIG. 2 is a perspective view of the arrow broad with the cutting blades released and fully extended into a locked position at target contact.

The arrow broadhead 10 includes a rotating, sliding shaft 16 with a pointed tip 18 formed in a front portion 15 of the shaft 16. The pointed tip 18 is tapered rearwardly and outwardly forming a tip base 20. The tip base 20 includes cutting blade grooves 22 formed therein and parallel to a length of the sliding shaft 16. The cutting blade grooves 22 are used for receiving a pivot end 24 of two or more of cutting blades 26 equally spaced around a circumference of the tip base 20. In this drawing, two of the cutting blades 26 are shown. In FIG. 2, three of the cutting blades 26 are shown and equally spaced around the tip base 20. The pivot end 24 of the cutting blades 26 is attached to the sides of the grooves 22 using pivot pins 28.

While one or two cutting blades 26 can be used on the broadhead 10, three cutting blades are preferred. Also, up to five cutting blades could be mounted equally well on the broadhead.

It should be mentioned that a key feature of the broadhead 10 is the pointed tip 18 with spirally wound, scalloped grooves 29 therein. The scalloped grooves 29, during flight and during target contact, provide for rotating the pointed tip 18, the tip housing 20 with attached cutting blades 26 and the sliding shaft 16, as indicated by arrows 31. As mentioned above, this feature during arrow flight reduces planning and wind resistance with improved flight accuracy.

Each of the cutting blades 26 include an outer cutting edge 30 and an inner edge 32. The inner edge 32 of the blades 26 is disposed next to a portion of a length of the sliding shaft 16. Also, the inner edge 32 of the blades 26 is characterized by having a forward portion 34 with a beveled cam surface 36 and a rearward portion 38. The rearward portion 38 is also parallel to the length of the sliding shaft 16.

While the beveled cam surface 36 is shown in the forward portion of the blades 26, it should be kept in mind various cam surfaces can be designed on the inner edge 32 of the blades 26. Also, the entire length of the inner edge 32 can be sloped slightly upward from front to rear of the blade and provide a cam surface for expanding the blades on target contact.

A middle portion 39 of the sliding shaft 16 is slidably received inside and through a hollow collar 40. The exterior of the collar 40 is treaded or press fitted on a top portion 42 of a sliding shaft housing 44. The hollow collar 40 acts as a cylinder for allowing the shaft 16 to both slide and rotate therein during arrow flight and during target contact. Also, the arrow shaft 14, attached to the sliding shaft housing 44, is free to rotate around the sliding shaft 16.

In another embodiment of the broadhead 10, the cutting blades 26 can be folded into elongated, parallel grooves along a length of the sliding shaft housing 40. This feature will provide a smaller and more streamlined profile of the broadhead 10 during flight. This feature of the elongated, parallel grooves is not shown in the drawings.

In this drawing, the cutting blades 26 are shown held in a retracted position using a blade catch 45 extending outwardly from a portion of the inner edge 32. The blade catch 45 is biased against a lower lip of a crown 47 on top of the hollow collar 40. While the blade catch 45 is shown engaging the hollow collar 40, it can be appreciated that there is any number of catches or grooves that can be incorporated into the inner edge 32 of the cutting blade 26 and along the length of the sliding shaft housing 44.

The sliding shaft housing 44 includes a collar bore hole 46 with an threaded upper end 48. The threaded upper end 48 of the collar bore hole 46 is used for threading the hollow collar 40 thereon. Also, the hollow collar 40 can be press fitted in the collar bore hole 46. Further, the hollow collar 40 can be threaded or press fitted around the outside of the top portion of the sliding shaft housing 44. The feature of the collar being threaded or press fitted around the outside of the top portion of the sliding shaft housing is not shown in the drawings.

In the lower end of the middle portion 39 of the shaft 16 is an annular groove 50 for receiving a ring keeper 52. The ring keeper 52 prevents the sliding shaft 16 from being removed from inside the threaded hollow collar 40. While the ring keeper 52 is shown in the drawings, various types of shaft retaining devices such as a threaded nut, key, pin or a widened area in the shaft 16 can be used equally well.

Also, the sliding shaft housing 44 includes a smaller, sliding shaft lower bore hole 54 for receiving a lower end portion 56 of the sliding shaft 16. While the lower bore hole 54 is shown to add strength to the sliding shaft housing 44 for receiving the sliding shaft 16, the shaft can be shortened and slide only inside the collar bore hole 46, thus eliminating the need of the lower bore hole 54.

A threaded lower end 58 of the sliding shaft housing 44 is used for attachment to an arrow shaft insert 60 in the hollow arrow shaft 14. The lower end 58 can also be without threads and attached to the arrow shaft insert 60 in a press fit. Typical, hunting arrows include the arrow shaft insert 60, therefore, the arrow broadhead 10 can be easily attached to different types of arrows by merely threading the sliding shaft housing 44 into the arrow shaft insert 60 as shown.

The collar bore hole 46 includes a coil spring 62, mounted therein and shown in cross section, and received around the lower end portion 56 on the sliding shaft 16. The coil spring 62 is biased against the ring keeper 52 for pushing the sliding shaft 16 and pointed tip 18 forward toward the direction of the target 11. The bias force of the coil spring 62 is indicated by arrow 64. Also, this bias force 64 urges the blade catches 45 of the cutting blades 26 against the lower lip of the crown 47 on the hollow collar 40, thus holding the blades 26 in a retracted position during arrow flight.

Also in this drawing, the cutting blades 26 are shown with an inverted "V" shaped locking notch 66 formed in the inner edge 32 of the beveled cam surface 36. The locking notch 66 is disposed in the forward portion 34 of the blade. The feature of the locking notch 66 is important in that when the cam surface 36 slides against a portion of the hollow collar 40 and when the cutting blade 26 is in an extended position, the locking notch 66, as shown in FIGS. 1B and 2, drops into a locked position on a side of the hollow collar 40 thus holding the blade in the extended position.

Further shown in this drawing and as an option, the pointed tip 18 can include a removable, razor sharp, replaceable tip 68. A dulled or damaged tip 68 can be removed and replaced by removing a locking pin 70. The locking pin 70 is threaded into the tip base 20 and through a lower end portion 72 of the tip 68. The end portion 72 is received in a groove in the front of the tip base 20. This end portion 72 is shown in dashed lines.

Figure 1A:
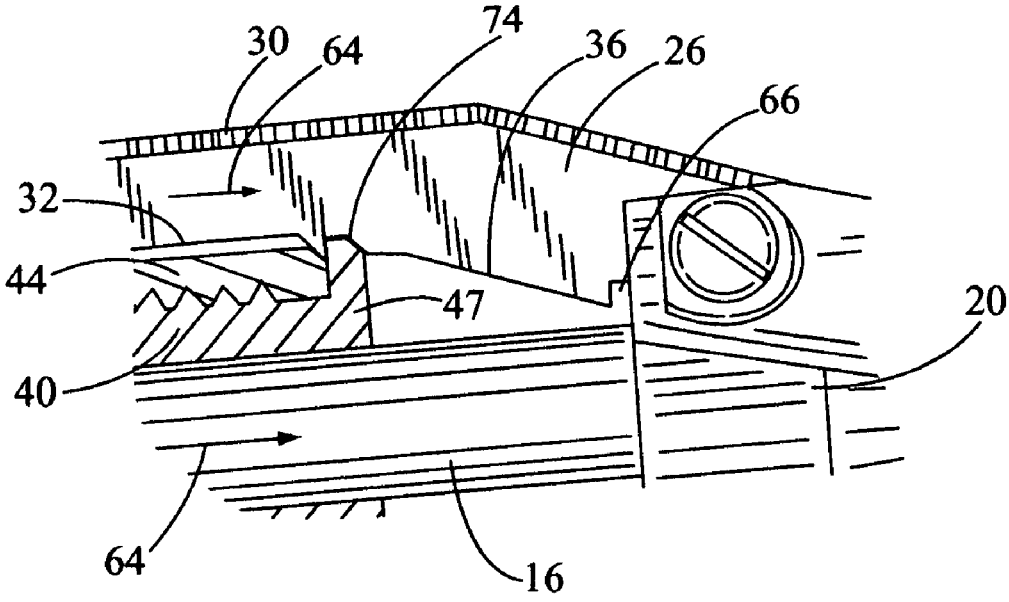
FIG. 1A is an enlarged sectional view of a cutting blade with a blade groove for engaging a portion of the crown on the hollow collar for holding the blade in a retracted position during arrow flight.

In FIG. 1A, an enlarged sectional view of a portion of the cutting blade 26 is shown with a blade groove 74 used for engaging a portion of an outwardly extending crown 47 on the hollow collar 40. In this example, the crown 47 is used for holding the blade 26 in a retracted position during arrow flight. The forward bias force from the coil spring 62 on the shaft 16 and the blade 26 is shown as arrows 64. Obviously, this is another way of holding the cutting blades next to the side of the sliding shaft housing 44 and in a retracted position.

Figure 1B:
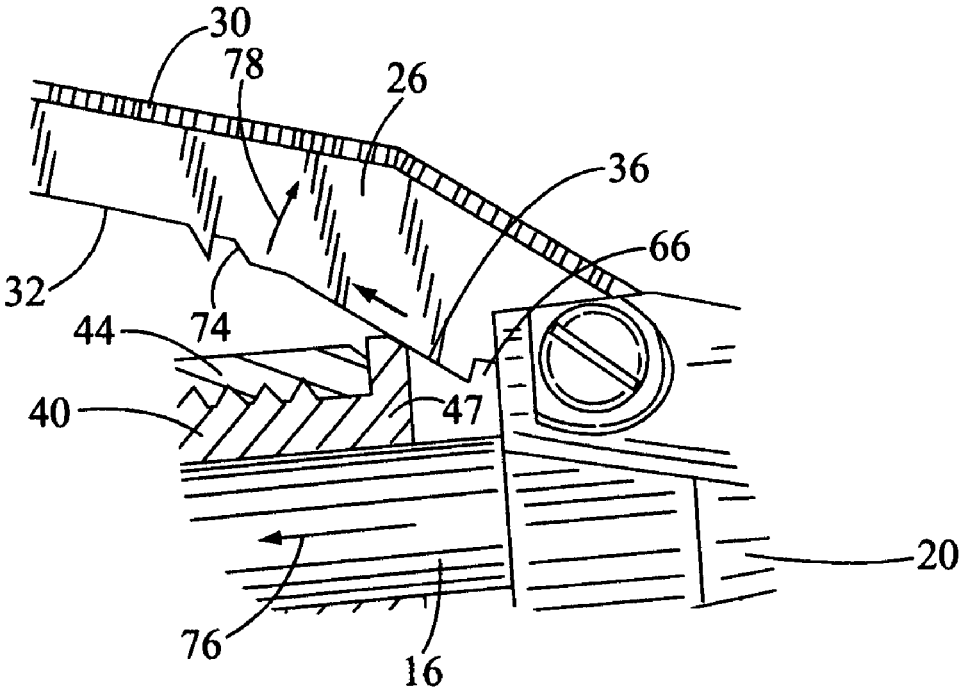
FIG. 1B is another enlarged sectional view of the release of the cutting blade next to the side of the hollow collar and sliding shaft housing, when the pointed tip makes target contact.

In FIG. 1B, another enlarged sectional view of a portion of the cutting blade 26 is shown and after target contact. In this drawing, rotating, sliding shaft 16 is moving rearward, as indicated by arrow 76, in the sliding shaft housing 44. At this time and as the blade 26 also moves rearward, the blade groove 74 is released from its engagement with the crown 47 of the hollow collar 40. The cam surface 36 is now sliding along a portion of the crown 47 of the hollow collar 40 and rotating the cutting blade 26 outwardly into an extended position, as indicated by arrow 78.

In FIG. 2, the broadhead 10 is shown with three cutting blades 26 in a fully extended and locked position upon contact of the pointed tip 18 on the target 11. When the pointed tip 18 contacts the target 11, the rotating, sliding shaft 16 moves rearward with the lower end portion 56 moving into the lower borehole 54 and compressing the coil spring 62 as shown. At this time, the blade catch 45 of each blade 26 is released from the lower lip of the hollow collar 40 and the cam surface 36 begins to ride along the side of the collar until the locking notch 66 drops into a locked position on the hollow collar 40 as shown. As mentioned above, the feature of the use of the coil spring 62 and the blade catch 45 on the blades 26, or similar releasable securing means, eliminates the need of having to use an external, stretchable band around the blades to keep them in a retracted position during arrow flight.

It should be mentioned that should the pointed tip 18 contact a bone rib and be deflected in the target, the hollow arrow shaft 14, the arrow shaft insert 60 and the sliding shaft housing 44 are free to rotate around the shaft 16 and thus maintain the broadhead's forward inertia moving through the target 11. The is an added feature to the broadhead 10 through the use of the sliding shaft 16 in the sliding shaft housing 44.

While the invention has been particularly shown, described and illustrated in detail with reference to the preferred embodiments and modifications thereof, it should be understood by those skilled in the art that equivalent changes in form and detail may be made without departing from the true spirit and scope of the invention as claimed except as precluded by the prior art.

The embodiments of the invention for which an exclusive privilege and property right are claimed are defined as follows:

1. An arrow broadhead adapted for attaching to an open end of a hollow arrow shaft, the broadhead adapted for moving from a retracted position during arrow flight to an extended position when contacting a target, the broadhead comprising:

a rotating, sliding shaft having a pointed tip, said pointed tip disposed in a front portion of said shaft, said pointed tip tapered rearwardly and outwardly forming a tip base;

at least two cutting blades pivotally attached to said tip base, said blades including an outer cutting edge and an inner edge, the inner edge of said blades including a beveled cam surface;

a sliding shaft housing having a bore hole therein and a lower end, said sliding shaft housing receiving said rotating, sliding shaft therein, a lower end portion of said sliding shaft received in said bore hole, the lower end of said sliding shaft housing adapted for receipt inside the open end of the hollow arrow shaft;

a coil spring mounted inside said bore hole and engaging a portion of said shaft, said coil spring biasing said shaft, said pointed tip and said blades forward toward the direction of the target; and blade retraction means disposed on the inner edge of said blades and on said sliding shaft housing for holding said blades in a retracted position during arrow flight;

whereby, when said pointed tip contacts a target, said sliding shaft moves rearward into said bore hole, said blade retraction means releases said blades from said sliding shaft housing, and the beveled cam surface of said blades contacts a side of said sliding shaft housing and moves said blades outwardly from a folded, retracted position into an extended position.

2. The broadhead as described in claim 1 further including a hollow collar for receiving a portion of said rotating, sliding shaft therethrough, said hollow collar attached to a front portion of said sliding shaft housing.

3. The broadhead as described in claim 2 wherein said hollow collar is threaded inside said bore hole in said sliding shaft housing.

4. The broadhead as described in claim 2 wherein said hollow collar is threaded to an upper end of said sliding shaft housing and next to said bore hole.

5. The broadhead as described in claim 2 wherein said blade retraction means includes a blade catch extending outwardly from the inner edge of said blades, said blade catch engaging a lower lip of a crown on said hollow collar during arrow flight.

6. The broadhead as described in claim 2 wherein said blade retraction means includes a blade groove in a portion of the inner edge of said blades, said blade groove engaging a side of a crown on said hollow collar during arrow flight.

7. The broadhead as described in claim 1 wherein said pointed tip with tip base is formed into a one-piece unit with said sliding shaft.

8. The broadhead as described in claim 1 wherein a front portion of said sliding shaft is threaded into an opening in the tip base of said pointed tip.

9. The broadhead as described in claim 1 wherein a front portion of said sliding shaft is press fitted into an opening in the tip base of said pointed tip.

10. The broadhead as described in claim 1 wherein a front portion of said sliding shaft is pinned inside an opening in the tip base of said pointed tip.

11. The broadhead as described in claim 1 further including three cutting blades equally spaced around a circumference of said tip base and pinned inside grooves in the side of said tip base.

12. The broadhead as described in claim 1 further including a round hollow arrow shaft insert adapted for receipt in the open end of the arrow shaft, wherein said lower end of said sliding shaft housing is threadably attached to said arrow shaft insert.

13. The broadhead as described in claim 1 further including three cutting blades equally spaced around a circumference of said tip base and pinned inside grooves in the side of said tip base.

14. The broadhead as described in claim 1 wherein said pointed tip includes spirally wound, scalloped grooves therein for helping rotate said pointed tip, said cutting blades and said rotating, sliding shaft during arrow flight and said scalloped grooves helping increase penetration into the target.

15. An arrow broadhead adapted for attaching to an open end of a hollow arrow shaft, the broadhead adapted for moving from a retracted position during arrow flight to an extended position when contacting a target, the broadhead comprising:

a rotating, sliding shaft having a spirally wound, scalloped grooved pointed tip, said pointed tip disposed in a front portion of said shaft, said pointed tip tapered rearwardly and outwardly forming a tip base;

at least two cutting blades pivotally attached to said tip base, said blades including an outer cutting edge and an inner edge, the inner edge of said blades including a beveled cam surface, also the inner edge of said cutting blades having a locking notch therein;

a hollow collar for receiving a portion of said rotating, sliding shaft therethrough;

a sliding shaft housing having a bore hole therein and a lower end, said hollow collar attached to a front portion of said sliding shaft housing, a lower end portion of said rotating, sliding shaft received in said bore hole, the lower end of said sliding shaft housing adapted for receipt inside the open end of the hollow arrow shaft;

a coil spring mounted inside said bore hole and engaging a portion of said shaft, said coil spring biasing said shaft, said pointed tip and said blades forward toward the direction of the target; and blade retraction means disposed on the inner edge of said blades and on said hollow collar for holding said blades in a retracted position during arrow flight;

whereby, when said pointed tip contacts a target, said sliding shaft moves rearward into said bore hole, said blade retraction means releases said blades from said hollow collar, and the beveled cam surface of said blades contacts a side of said hollow collar and moves said blades outwardly from a folded, retracted position into an extended position.

16. The broadhead as described in claim 15 wherein said blade retraction means includes a blade catch extending outwardly from the inner edge of said blades, said blade catch engaging a lower lip of a crown on said hollow collar during arrow flight.

17. The broadhead as described in claim 15 wherein said blade retraction means includes a blade groove in a portion of the inner edge of said blades, said blade groove engaging a side of a crown on said hollow collar during arrow flight.

18. The broadhead as described in claim 15 further including a round hollow arrow shaft insert adapted for receipt in the open end of the arrow shaft, wherein the exterior of the lower end of said sliding shaft housing is threadably attached to said arrow shaft insert.

19. The broadhead as described in claim 15 wherein said pointed tip includes a replaceable tip, a lower end portion of said replaceable tip received in a groove in a front of said tip base and pinned thereto.

20. An arrow broadhead adapted for attaching to an open end of a hollow arrow shaft, the broadhead also adapted for moving from a folded, retracted position to an extended position when contacting a target, the broadhead comprising:

a rotating, sliding shaft having a spirally wound, scalloped grooved pointed tip, said pointed tip disposed in a front portion of said shaft, said pointed tip tapered rearwardly and outwardly forming a tip base;

at least two cutting blades pivotally attached to said tip base, said blades including an outer cutting edge and an inner edge, the inner edge of said blades including a beveled cam surface, also the inner edge of said blades includes a locking notch therein; and a hollow collar adapted for receipt inside the open end of the hollow arrow shaft, a lower end portion of said sliding shaft slidably received inside said collar, a coil spring mounted inside said hollow collar and engaging a portion of said sliding shaft, said coil spring biasing said sliding shaft, said pointed tip and said blades forward toward the direction of the target; and blade retraction means disposed on the inner edge of said blades and on said hollow collar for holding said blades in a retracted position during arrow flight;

whereby, when said pointed tip contacts a target, said sliding shaft moves rearward into said bore hole, said blade retraction means releases said blades from said hollow collar, and the beveled cam surface of said blades contacts a side of said hollow collar and moves said blades outwardly from a folded, retracted position into an extended position.

21. The broadhead as described in claim 20 wherein said blade refraction means includes a blade catch extending outwardly from the inner edge of said blades, said blade catch engaging a lower lip of a crown on said hollow collar during arrow flight.

22. The broadhead as described in claim 20 wherein said blade retraction means includes a blade groove in a portion of the inner edge of said blades, said blade groove engaging a side of a crown on said hollow collar during arrow flight.

23. The broadhead as described in claim 20 further including an arrow shaft insert adapted for receipt in the open end of the arrow shaft, said hollow collar received inside said shaft insert.

24. The broadhead as described in claim 20 further including three cutting blades equally spaced around a circumference of said tip base and pinned thereto.

* * * * *